US005409227A

United States Patent [19]

Walker

[11] Patent Number: 5,409,227

[45] Date of Patent: Apr. 25, 1995

[54] PUZZLE

[76] Inventor: Kenneth E. Walker, 3384 Marina Ave., Livermore, Calif. 94550

[21] Appl. No.: 202,410

[22] Filed: Feb. 25, 1994

[51] Int. Cl.[6] ..... A63F 9/10

[52] U.S. Cl. ..... 273/157 R

[58] Field of Search ..... 273/157 R

[56] References Cited

U.S. PATENT DOCUMENTS

| | | | |
|---|---|---|---|
| Re. 32,663 | 5/1988 | Atkinson | 405/19 |
| 1,787,473 | 1/1931 | Dana | 273/157 R |
| 1,972,206 | 9/1934 | Thomay | 273/157 R |
| 2,443,468 | 6/1948 | Madden | 273/157 R X |
| 3,340,781 | 8/1965 | See | 94/13 |
| 3,578,331 | 5/1971 | DeGast | 273/157 R |
| 4,880,238 | 12/1989 | Derouin | 273/160 |

FOREIGN PATENT DOCUMENTS

| | | | |
|---|---|---|---|
| 15307 | 11/1887 | Netherlands | 273/160 |

OTHER PUBLICATIONS

Keith Winegar Puzzle Works leaflet, Oct. 1991.

Bits & Pieces Puzzle Catalog, Nov. 1993.

*Primary Examiner*—William H. Grieb

*Attorney, Agent, or Firm*—Flehr, Hohbach, Test Albritton & Herbert

[57] ABSTRACT

A puzzle is described made up of a plurality of parts which are assembleable/disassembleable. The parts are connected to one another via mating knobs and cavities which are tapered so that the parts move linearly with respect to one another. The parts in the embodiments described are only assembleable/disassembleable when they are in the right linear position with respect to one another and there is rotation. In some embodiments the parts making up the subassemblies must also be in the correct order, whereas in other embodiments the order is intentionally made variable.

23 Claims, 4 Drawing Sheets

FIG_10
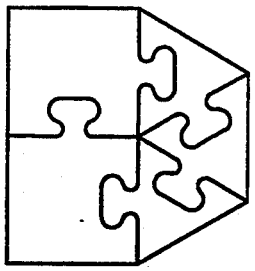
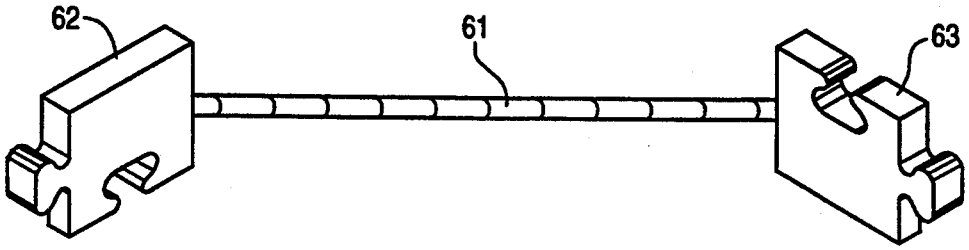
FIG_11A
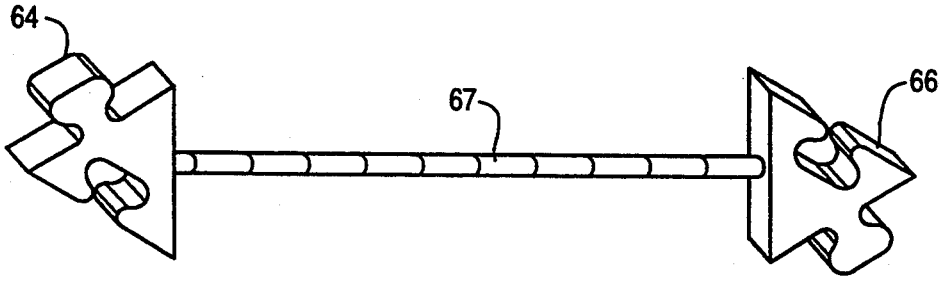
FIG_11B
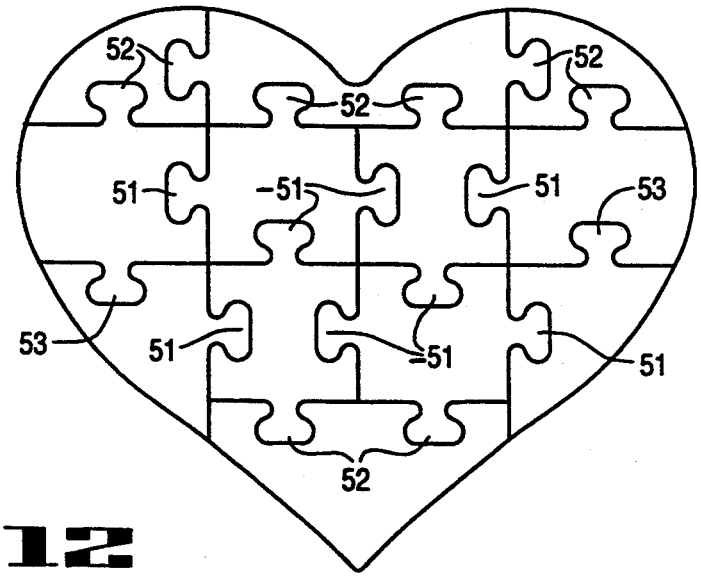
FIG_12

PUZZLE

BACKGROUND OF THE INVENTION

The present invention relates to interlocking arrangements and, more particularly, to an interlocking arrangement which is especially useful for manipulatable puzzles.

Puzzles which require manipulation either to disengage or connect parts, are quite common. Puzzles of this nature are solved when parts that are initially connected together are separated, or when parts which are disengaged initially are connected together in a particular manner.

SUMMARY OF THE INVENTION

The present invention is an interlocking arrangement which requires unusual manipulation for unlocking-/locking, in spite of the fact that the parts making up the arrangement seem to be quite loosely connected (or easily connectable) together. In its basic aspects, the interlocking arrangement of the invention includes subassemblies of parts that are connected/connectable together for relative movement. Each of the parts has a plurality of connectors configured to mate with complementary connectors on one or more other parts so as to prevent linear disengagement of the parts even though limited linear movement between the same is permitted. The connectors are also positioned and configured to disengage from (or engage) mating connectors upon relative rotation of certain part assemblies subsequent to a linear positioning of the parts.

Each part can be included as a component of more than one subassembly. In keeping with the invention, though, it is only certain subassemblies which, if selected and the parts making up the same are in the proper linear position, can be disengaged (or engaged) from one another.

The linear "looseness" of the arrangement when the parts are attached to one another leads one to subconsciously believe that it must be only some sort of linear movement which is responsible for the disconnection of the parts. This, however, is not so. Rather, it requires that the proper subassemblies be rotated when the parts are in the correct linear position. This combination of true rotary movement of the pieces relative to one another and linear positioning simply does not readily occur to many potential solvers. And when the interlocking arrangement is provided to a solver with the parts disassembled, the ease of obtaining much of the linear engagement hides the fact that rotary movement and correct linear positioning within the subassembly is necessary to construct the arrangement.

Although puzzles have been provided in the past which provide linear movement between parts and "twisting", insofar as applicant is aware none allow disconnection only when certain subassemblies of the parts are chosen and rotated. And insofar as applicant is aware, no one has truly understood the principle and recognized that the connectors can be mathematically defined so that the number of parts and subassemblies is variable.

The interlocking arrangement of the invention is especially useful in puzzles because of the mystifying nature of engaging or disengaging the parts. It is also usable, though, to provide other desirable interlocking mechanisms, particularly when it is desired that the interlocking pieces maintain quite a loose fit or when it is desired that the parts form differing subassemblies, some of which cannot be disengaged. That is, the invention provides a relatively strong but flexible positive connection mechanism which is not likely to come apart until desired and then only if correct subassemblies of parts are chosen.

Other features and advantages of the invention either will become apparent or will be described in connection with the following, more detailed description of preferred embodiments of the invention.

BRIEF DESCRIPTION OF THE DRAWING

With reference to the accompanying drawing:

FIG. 10 is a plan view illustrating a hybrid connection between parts of the FIG. 1 puzzle embodiment and the FIG. 7 embodiment;

FIGS. 11A and 11B illustrate construction kit modules made from interlocking arrangements corresponding respectively to the puzzle embodiments of FIGS. 1 and 7; and FIG. 12 is a heart-shaped puzzle embodiment of the invention.

DETAILED DESCRIPTION OF THE PREFERRED EMBODIMENTS

The following relatively detailed description is provided to satisfy the patent statutes. It will be appreciated by those skilled in the art, though, that various changes and modifications can be made without departing from the invention.

Figure 1:
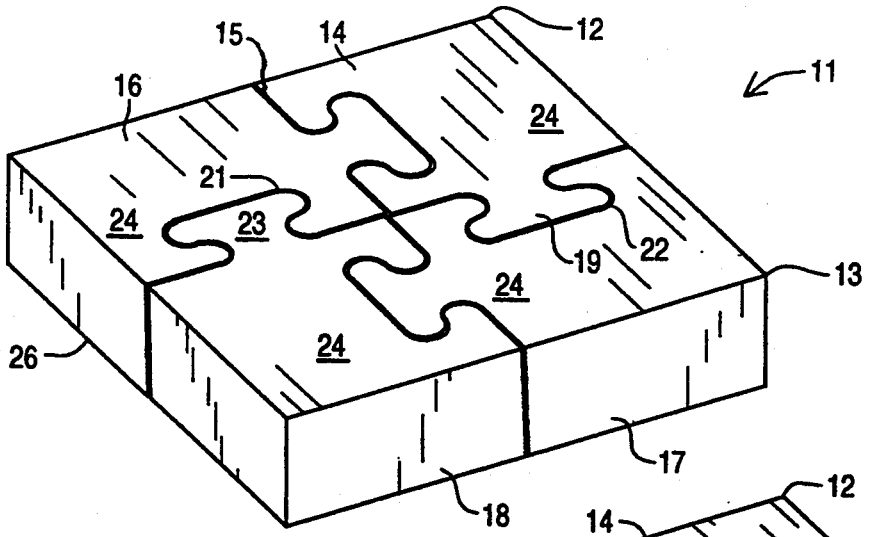
FIG. 1 is an isometric view of a preferred two-subassembly puzzle embodiment of the invention, each subassembly itself being made up of two parts.
Figure 4:
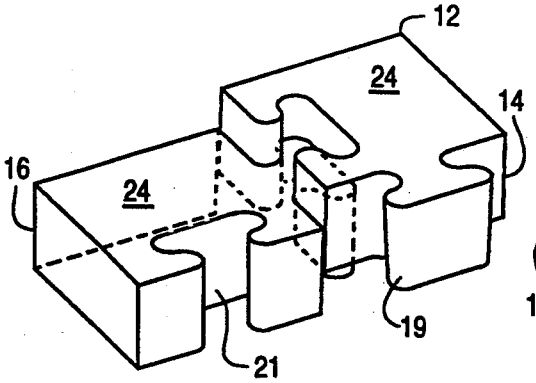
FIG. 4 is an isometric view of a two-part subassembly of the preferred puzzle embodiment of FIG. 1.

FIG. 1 illustrates a preferred embodiment of the invention. It is a manipulatable puzzle, generally referred to by the reference numeral 11. As is illustrated, such puzzle when in its fully engaged mode, is generally square in shape. It is made up of two rectangular subassemblies or pieces 12 and 13 each of which is itself made up of a pair of puzzle parts 14, 16 and 17, 18, respectively, with parts 14 and 16, for example, being separated by a gap 15 of width W. As best illustrated in FIG. 4 for subassembly 12, each subassembly has a pair of exposed connectors 19 and 21. Connector 19 is a knob which mates with and fits within a corresponding cavity 22 in subassembly 13. In this embodiment, such cavity is, in essence, the same as cavity 21 which receives a knob 23 of subassembly 13. However, each knob, cavity pair may deviate slightly from other knob, cavity pairs in order to provide a unique organization of parts. Each of the cavities 21 and 22 is reentrant and captures its complementary knob connector.

Although only subassembly 12 is shown in FIG. 4, in this embodiment subassembly 13 essentially is the same as subassembly 12. It may be different, though, in other embodiments.

It is to be noted that the subassemblies which have been identified are subassemblies 12 and 13. Other subassemblies of the parts can be formed. In this embodiment parts 14 and 17 can make up a subassembly and parts 16 and 18 another.

Each of the connectors 19–23 is associated with a respective one of the parts. That is, the knob 19 and cavity 21 are associated with the respective parts 14 and 16, whereas the cavity 22 and knob 23 are associated with the parts 17 and 18. Each also extends, as is illustrated, between opposed and parallel faces 24 and 26 of its associated part. It is to be noted that all parts in this embodiment are generally of the same thickness, i.e., that the distance between the faces 24 and 26 of each of the parts 14–18 is essentially the same. Moreover, in this embodiment the distance between the exposed connectors of each of the subassemblies 12 and 13, e.g., the distance between center of knob 19 and center of cavity 21, is generally twice the thickness of the parts.

Figure 5:
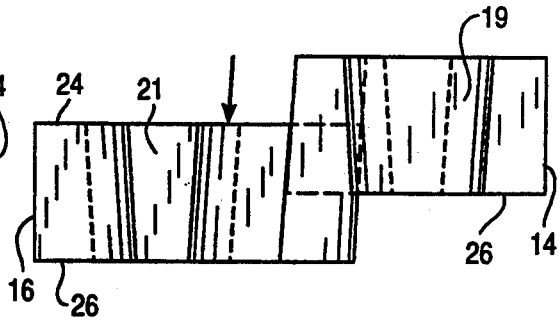
FIG. 5 is a side elevation view of the subassembly of FIG. 4.

The subassemblies are configured to mate with one another so as to prevent linear disengagement of the same while permitting limited linear movement between the parts. A simple and elegant way of accomplishing this function is to taper the mating connectors shown in FIGS. 4 and 5. It will be seen that part 14 is also restricted to move linearly relative to part 16 by approximately one-half (50%) in one direction, while being completely separable in the opposite direction.

The parts 14 and 16 of subassembly 12 and 17, 18 of subassembly 13 are connected together with the same connector types, with the connectors on each subassembly tapered in the same direction. For example, as illustrated in FIG. 4 the tapers of both the knob connector 19 and the cavity connector 21 taper inwardly from the face 24 to the face 26.

Figure 6:
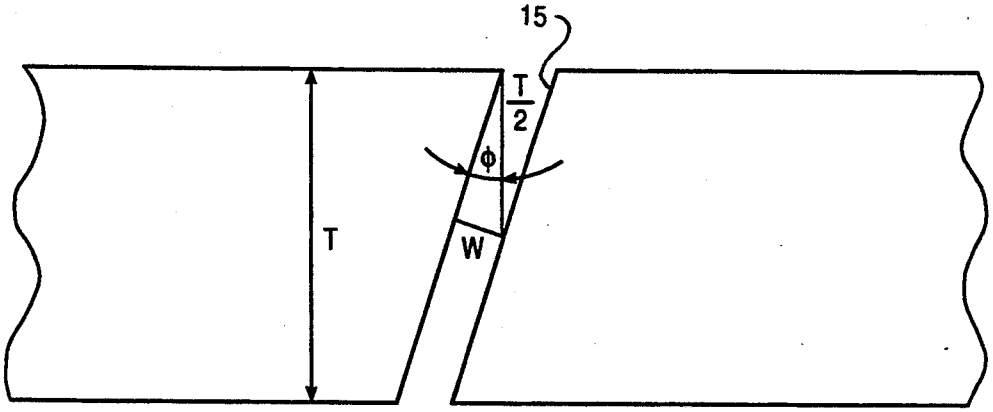
FIG. 6 is an enlarged partial elevation view showing the relationship of various dimensions.

The taper angle, $\phi$ (see FIG. 6), is chosen by the equation $$\phi = x \text{ Arcsin } \frac{w}{.5T},$$

where:

$\phi$ is the acute angle of taper;

w is the constant width of separation between the mated connectors when the surfaces of the parts with which they are associated are generally planar;

T is the distance between said external parallel surfaces with said distance of all of said parts being generally the same; and x is a value indicative of the number of connections making up a subassembly and the direction of taper.

Figure 2:
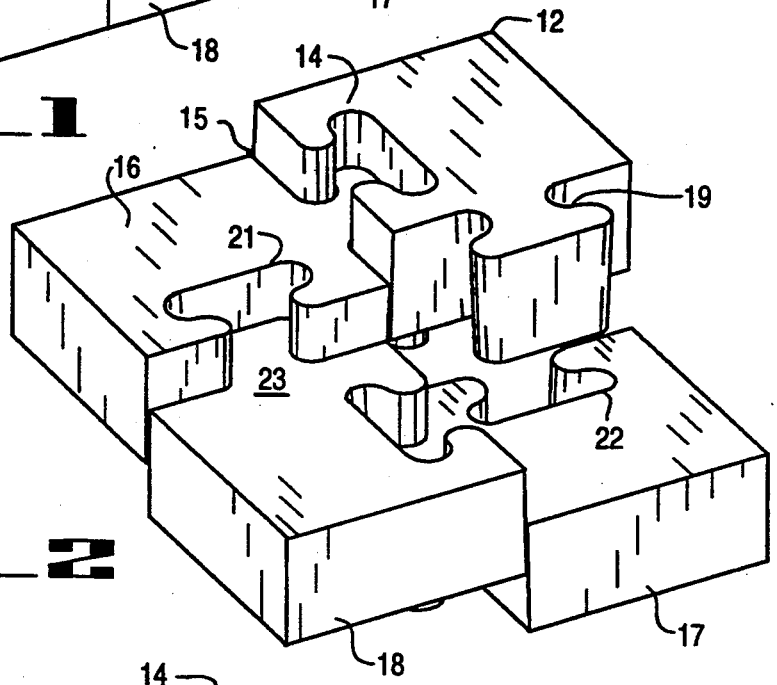
FIG. 2 is another isometric view of the puzzle of FIG. 1, illustrating a loose fit of the parts even though the puzzle remains positively interconnected when the parts are in the relative positions shown.

When the angle of taper is chosen by this equation and x=1, each of the parts is movable linearly with respect to its adjacent parts by approximately 50% of the distance between its faces. This is ideal for the embodiment of FIG. 1, and is illustrated in FIG. 2. That is, part 16 is 50% lower than part 14. The connectors 21 and 23 allow the part 18 to be, in turn, 50% lower than the part 16. The part 17 is likewise 50% lower than the part 18. It will be seen that when all of the parts are in the relationship shown in FIG. 2, the tapered knob connector 19 is completely disengaged from the cavity connector 22. However, the parts 14 and 17 still cannot be removed from the puzzle because of their respective matable connections to the parts 16 and 18. It has been found that taper angles as low as about 1° and as high as 15° provide satisfactory results in various embodiments.

Figure 3:
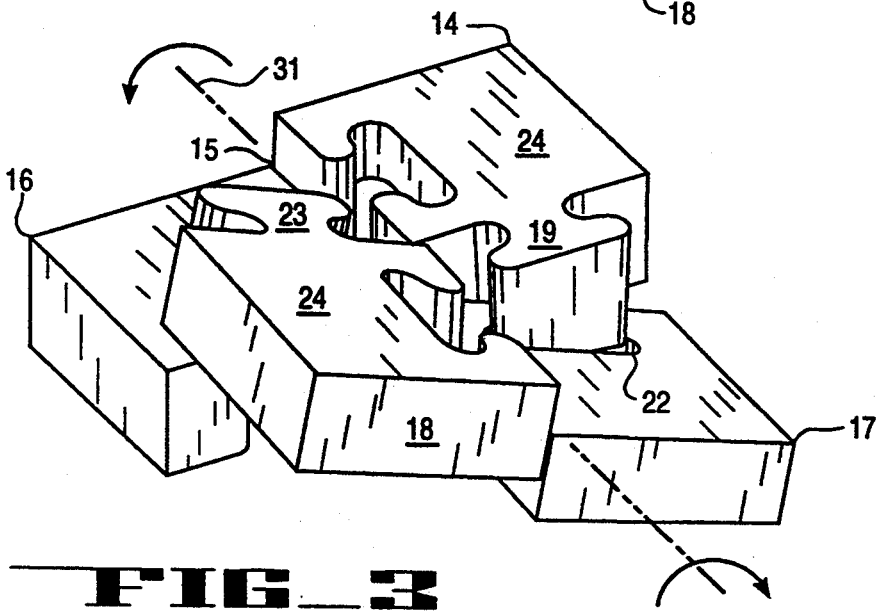
FIG. 3 is a third isometric view of the preferred puzzle embodiment of FIG. 1, illustrating the linear positioning of the parts and the rotation of the correct subassemblies for disengagement.

When a potential solver of the puzzle first picks the puzzle up, the limited linear movement of the parts permitted by the tapers will be easily discernable. Many astute solvers also will quickly discover the tapering nature of the connectors that is responsible for such limited movement. Even such discovery, though, will not suppress the subconscious supposition that it is simply linear movement between the parts that allows disengagement/engagement. This, however, is not true. The subassemblies and, hence, the parts only can be disengaged if there is rotation between the subassemblies as well as, in this preferred embodiment, a correct selection of part subassemblies and a specifically chosen linear position of the parts relative to one another. This rotation when the correct subassemblies are chosen and the various parts are in a particular linear relationship, is illustrated in FIG. 3. The rotation axis 31 runs along the displaced top faces of parts 16 and 17 within the gap 15, and midway between the top and bottom faces of parts 14 and 18. Parts 14 and 18 have to remain nearly planar and 16 and 17 must be allowed to reach the end of their limited axial travel, before disengagement will be allowed to occur. In this connection, gravity may be utilized to aid in solving the puzzle of the preferred embodiment. The solver need only hold the parts 14 and 18 planar with one another and allow the parts 16 and 17 to react to gravity by moving to their lower position, i.e., the end of their linear displacement range where they, too, are planar with each other. Once the parts are in such position, rotation about axis 31 will result simultaneously in disengagement of the knob 19 from the cavity 22 and of the knob 23 from the cavity 21. That is, the narrow end of each of the knobs interacts angularly with the wide end of the cavity connectors so as to be removable therefrom. Once one subassembly is disengaged from the other subassembly in this embodiment, the parts of each can be easily disengaged because of the tapering nature of their remaining connection.

It is to be noted that to solve the four-part puzzle of this embodiment, it is necessary that the correct subassemblies of the parts, i.e., subassemblies 12 and 13, be selected. If either no subassemblies or incorrect subassemblies are selected, then the parts will not be disassembleable. For example, if three-part, one-part subassemblies are selected, or two-part subassemblies are selected in which the parts making up the individual subassemblies are respectively parts 14 and 17, and parts 16 and 18, the subassemblies will not be disengageable.

It should be noted that the material from which the parts are made is relatively unimportant. They can be made from hardwood. For example, a block of wood can be cut with a scroll saw (or band saw or jigsaw) into the desired pieces with a proper angle to provide the right taper angle, $\phi$, corresponding to the dimensions of the block. They also can be cast in metal or molded from a plastic. Moreover, the shape of the mating connectors can be varied as desired, although it is preferred for simplicity that one be a male connector and the other be a female connector.

It will be recognized that to engage the pieces the reverse of the operation described above is necessary. The correct subassemblies have to be constructed. The relationship of the two correct subassemblies must be selected so that the faces 24 of pieces 14 and 18 are planar and pieces 16 and 17 are at the lower end of their limited displacement range. The pieces then can be connected together by rotating the same about the axis 31 in the direction opposite the direction used to disengage such pieces.

As mentioned previously, in this embodiment it is necessary that the correct subassemblies of parts be selected for disassembly and/or assembly. In order to assure that only rotation about the axis 31 will result in disengagement/engagement, the tolerance between the connections should be quite good. If the tolerance is not good, it may be possible to rotate subassemblies of parts about an axis which is 90° from axis 31 in order to cause disengagement/engagement. When the tolerances between the connectors are good, subtle differences can be introduced into the parts to eliminate symmetry and insure that only rotation about the axis 31 results in the desired disengagement. For example, slightly different taper angles can be employed.

Figure 8:
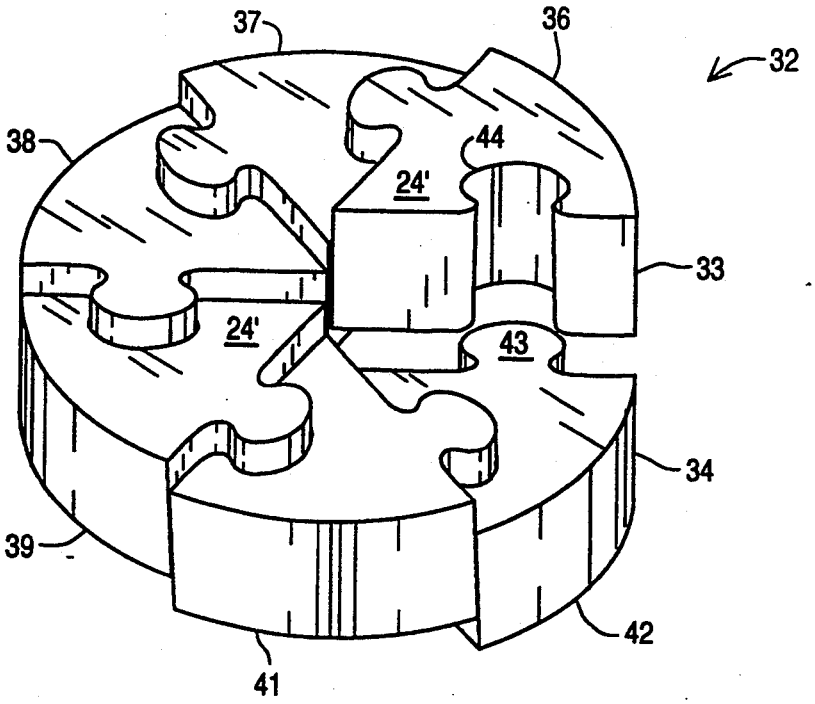
FIG. 8 is an isometric view of the puzzle embodiment of FIG. 7, showing the looseness of fit between the parts even though they are positively interconnected when they are in the relative positions shown.
Figure 9:
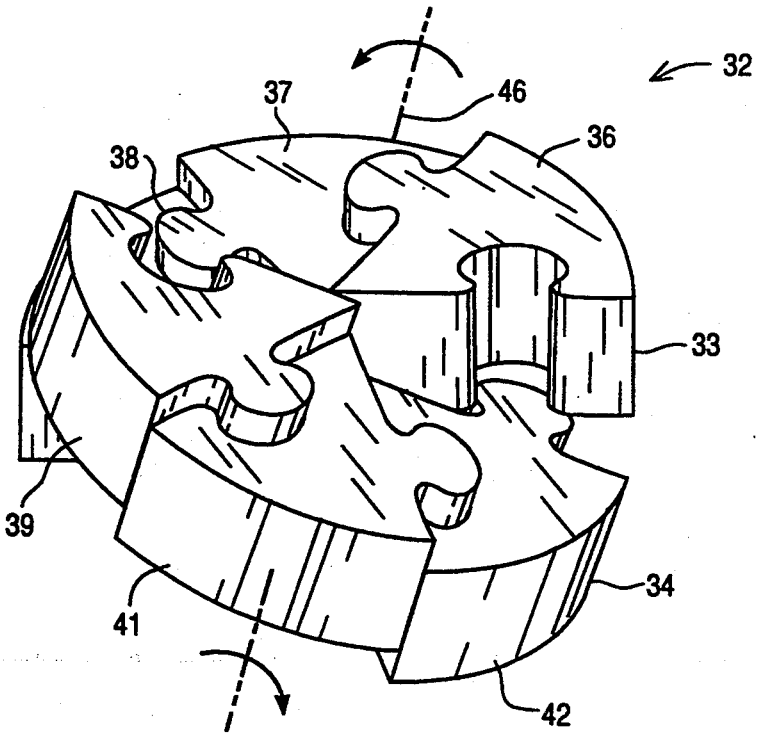
FIG. 9 is a third isometric view of the preferred puzzle embodiment of FIG. 7, illustrating one manner in which the puzzle parts can be disengaged from one another.

Although there are other ways to specifically configure the mating connectors in accordance with the broad concept of the invention, it has been found, as mentioned previously, that the tapering configuration described above is a quite elegant way of achieving the desired relationships. To provide a drop of one-half for a four-part puzzle as described, x in the equation is selected to be 1. x, though, can be another number. For example, if x is selected to be 2 (or −2), the taper angle allows a drop of approximately one-fourth of the distance between the part faces. Choosing this value for a four-part puzzle will result in an impossible to disassemble configuration. However, such a value is ideal for a six-part puzzle having two subassemblies which are individually made up of three parts. Such a puzzle embodiment of the invention is generally referred to by the reference numeral 32 in FIGS. 7, 8 and 9. It is made up of two subassemblies 33 and 34 which in turn are made up of three parts 36,37,38 and 39,41,42, respectively. It will be seen from FIG. 8 that with the taper chosen the mating connectors allow the parts to move by one-fourth relative to one another. It will also be seen from FIG. 8 that the result of full limited displacement of each of the parts relative to the other will result in complete disengagement of knob connector 43 from reentrant cavity 44. The parts having these connectors cannot be removed, though, from the remainder of the construction in view of their other connectors. The puzzle only can be disengaged by rotation of correct subassemblies about an axis 46. This is illustrated in FIG. 9. More particularly, the upper faces of the pieces 39 and 36 have to remain roughly planar while the rotation is accomplished with the other parts at the lower end of their limited taper displacement ranges.

The puzzle may be assembled simply by following the reverse procedure of that described above once correct subassemblies are formed. Moreover, the individual parts can all be the same so that the puzzle is disengageable by rotation about three different axes, or there can be subtle differences so that only disengagement (and assembly) can be made with rotation about axis 46. There are so many possible combinations of parts and differing subassemblies when there are more than four parts, as a practical matter in most situations a puzzle is made which is disengageable by selecting differing subassemblies for rotation about differing axes. It should be noted that sufficiently loose tolerance or "sloppiness" in the mating connectors can be provided to enable the rotation around differing axes.

Puzzles can be made up combining two-part and three-part subassemblies if appropriate spacing between the mating connectors is maintained. FIG. 10 is included simply to illustrate this point. The number of pieces and the exterior configuration of the puzzle is not limited.

FIG. 12 illustrates a heart-shaped puzzle which utilizes tapers in which x in the equation $=1$; $-1$ (the same taper but the opposite direction to that in which $x=1$); 1.5; and 2.5. The mating connector arrangements in which the taper angle is determined with the equation when $x=1$ are indicated by the reference numeral 51, those for $x=-1$ by $-51$, those for $x=1.5$ by 52 and those for $x=2.5$ by 53. Although x can be equal to larger positive or negative numbers and there can be more parts, as a practical matter it has been found that if x is outside the range of $-3$ to $+3$, the puzzle becomes needlessly complex, i.e., such complexity is not needed in view of the various combinations which can be utilized to make a difficult-to-solve arrangement. The difficulty can be increased by the manner in which the puzzle is presented to the solver. If it is presented in dissembled form and for solution it is required that the parts be in the correct order for the subassemblies, then only when such order is achieved can a solution be obtained. For example, in the heart embodiment described the puzzle is normally presented to the solver in disassembled form (a broken heart) so that not only must the parts be placed into the proper subassemblies, the subassemblies themselves must be engaged in the correct order. It will be recognized that different part and subassembly order arrangements can be required (or not required) in a given puzzle as desired by the puzzle designer.

The concepts of the invention are utilizable in a three dimensional puzzle or other arrangement in which there are at least three pieces and one is not in the same two dimensional plane as the other two. And while the invention has been described in detail relative to its use with manipulatable puzzles, it will be recognized by those skilled in the field that the interlocking provided by the same is usable in other arrangements. For example, the parts can be provided as the ends of rods or the like which are to be connected. FIG. 11A shows an arrangement in which there is a rod 61 having a pair of parts 62 and 63, each of which is similar to any one of parts 14–18, secured at its opposite ends. This securance can be of any desired form, such as via interengaging threads. It is to be noted that in this arrangement there are two free sides and depending upon the desired interlocking construction it may be appropriate to provide rods from both free sides. Moreover, it may be appropriate to provide more than one rod between each of the sides with, for example, one of the rods connected more permanently to an associated one of the end connectors than to the other. Moreover, the angle that each of the connectors makes with the threaded rod can be varied depending upon the ultimate desired assembly. And the rods 61 and 67 may be flexible if desired.

Figure 7:
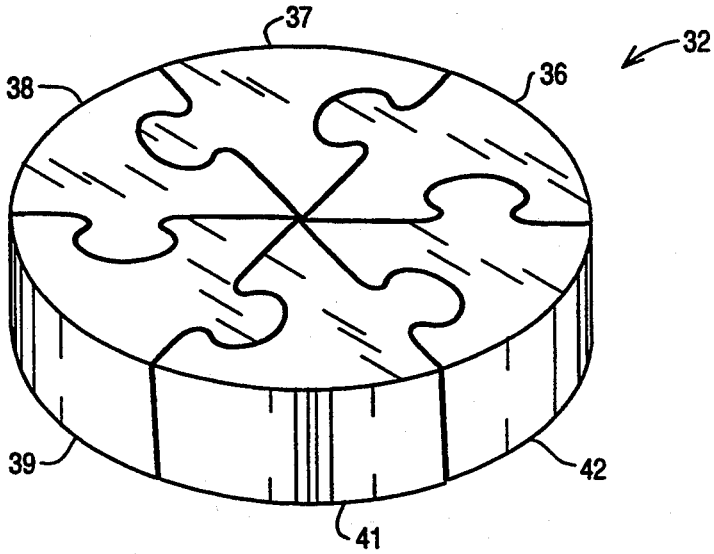
FIG. 7 is an isometric view of another preferred puzzle embodiment of the invention.

FIG. 11B illustrates an arrangement similar to FIG. 11A except that the end parts 64 and 66 are similar to the parts 36–42 of the puzzle embodiment of FIG. 7 et seq. It is to be noted that in this embodiment there is only one free side on each of such parts.

There are many construction arrangements which may make use of the constructions shown in FIGS. 11A and 11B. They may be utilized, for example, at the ends of tent poles to enable simple interconnection. Another potential utilization of these arrangements is interlocking modules for creative and educational purposes.

The advantages of the invention in summary form are, among others: the actual connect/disconnect technique provided by it is mystifying to the uninformed. It provides a relatively strong but flexible positive connection that is not likely to come apart until desired. It requires no additional nor loose parts, although it is recognized that in some applications additional parts may be useful. Worn parts are simply easier to connect-/disconnect, whereas the actual locked connection is little affected by wear unless, of course, the distinction between connection/disconnection is quite slight.

As mentioned at the beginning of the detailed description, applicant is not limited to the specific embodiments described above. Various changes and modifications can be made. For example, one of the major uses of the interlocking construction is as clasps to fasten clothing openings together instead of buttons or zippers. The advantage of the interlocking provided by the invention is that although it is quite positive, it appears quite loose. Moreover, disconnection to the uninformed is mystifying. The claims, their equivalents and their equivalent language define the scope of protection.

What is claimed is:

1. An interlocking arrangement comprising:

(a) a plurality of subassemblies of parts connectable together for relative movement therebetween;

(b) a plurality of connectors provided by the parts making up each of said subassemblies, each of said connectors being configured to lock with a complementary connector on another subassembly of said arrangement so as to prevent linear disengagement of connected subassemblies while permitting limited linear movement therebetween, and each of which is positioned and configured to disengage from its complementary connector upon relative rotation of certain of said subassemblies about a single rotation axis when said parts are at a selected linear position relative to one another; and (c) each of said parts cooperating with one or more adjacent parts to make up differing subassemblies, and said single rotation axis being defined only when said certain subassemblies are selected.

2. The interlocking arrangement of claim 1 wherein each of said certain subassemblies is made up of at least two parts, each of which defines at least one of said connectors which extends between a pair of opposed generally parallel external surfaces of its associated part, and each of said parts facing in generally the same direction as the other so that the external surfaces of the separate parts are generally parallel to one another and the distance between the connectors on said two parts is generally twice the distance between the parallel external surfaces of any one of said parts.

3. The interlocking arrangement of claim 1 wherein each of said connectors is configured to mate with its complementary connector.

4. The interlocking arrangement of claim 1 wherein the plurality of parts of each of said subassemblies are also connected together via one or more locking connectors which prevent linear disengagement of said parts while permitting limited linear movement therebetween.

5. The interlocking arrangement of claim 1 wherein each of said parts includes at least one of said connectors tapering between a pair of opposed, generally parallel external surfaces of its associated part.

6. The interlocking arrangement of claim 5 wherein the taper of each connector is chosen by the equation $$\phi = x \operatorname{Arcsin} \frac{w}{.5T},$$

where:

$\phi$ is the angle of taper;

w is the constant width of separation between locked connectors when the surfaces of the parts with which they are associated are generally planar, measured at generally about one-half the distance between such surfaces;

T is the distance between said external parallel surfaces with said distances of all of said parts being generally the same; and x has a value indicative of the number of connections making up a subassembly and the direction of said taper.

7. The interlocking arrangement of claim 6 wherein x is equal to 1 and there are two parts making up said subassembly.

8. The interlocking arrangement of claim 7 wherein said angle provides movement of said parts relative to one another which is generally about one-half of the distance between the parallel external faces of one of said parts.

9. The interlocking arrangement of claim 6 wherein x is equal to 2 and there are three of said parts making up said certain subassemblies.

10. The interlocking arrangement of claim 6 wherein said angle provides movement of said parts relative to one another equal to generally one-fourth of the distance between the parallel faces of one of said parts.

11. An interlocking arrangement comprising:

(a) a plurality of subassemblies of parts that are connected together for relative movement therebetween, at least one of said subassemblies having at least three parts; and (b) a plurality of connectors provided by the parts making the same up on each of said subassemblies, each of said connectors being configured to lock with a complementary connector on another subassembly of said arrangement so as to prevent linear disengagement of the connected subassemblies while permitting limited linear movement therebetween, and each of which is positioned and configured to disengage from its complementary connector upon relative rotation of said subassemblies when said parts are at a selected linear position relative to one another.

12. The interlocking arrangement of claim 11 wherein each of said subassemblies defines at least one of said connectors which extends between a pair of opposed generally parallel external surfaces of its associated part, each of said parts facing in generally the same direction as the other so that the external surfaces of the separate parts are also generally parallel to one another, the distance between the connectors on separate parts is generally twice the distance between the parallel external surfaces of any one of said parts.

13. The interlocking arrangement of claim 11 wherein each of said connectors is configured to mate with its complementary connector.

14. The interlocking arrangement of claim 11 wherein the plurality of parts of each of said subassemblies are also connected together via one or more locking connectors which prevent linear disengagement of said parts while permitting limited linear movement therebetween.

15. The interlocking arrangement of claim 11 wherein each of said parts includes at least one of said connectors tapering between a pair of opposed, generally parallel external surfaces of its associated part.

16. The interlocking arrangement of claim 15 wherein the taper of each connector is chosen by the equation $$\phi = x \operatorname{Arcsin} \frac{w}{.5T},$$

where:

$\phi$ is the angle of taper;

w is the constant width of separation between locked connectors when the surfaces of the parts with which they are associated are generally planar, measured at generally about one-half the distance between such surfaces;

T is the distance between said external parallel surfaces with said distance of all of said parts being generally the same; and x has a value indicative of the number of connections making up a subassembly and the direction of said taper.

17. The interlocking arrangement of claim 16 wherein the direction of taper of some of the locked connectors is different than the direction of taper of other of said locked connectors.

18. The interlocking arrangement of claim 16 wherein x is equal to 2.

19. The interlocking arrangement of claim 16 wherein said angle provides movement of said parts relative to one another equal to generally one-fourth of the distance between the parallel external faces of one of said parts.

20. A piece to be interlocked with one or more similar pieces, comprising the combination of:

(a) at least three parts connected together for relative linear movement along an axis;

(b) a pair of connectors associated with respective ones of said three parts, each of said connectors being configured to mate with a corresponding complementary connector provided by another piece; and (c) each of said connectors being positioned on its associated part to disengage or engage with said complementary connector when said parts of said piece are at a selected position relative to one another and said connector is rotated relative to said complementary connector.

21. The interlocking piece of claim 20 wherein each of said connectors tapers between a pair of opposed, generally parallel external surfaces of its associated part.

22. The interlocking piece of claim 21 wherein the taper of said connectors is chosen by the equation:

$$\phi = x \operatorname{Arcsin} \frac{w}{.5T},$$

where:

$\phi$ is the acute angle of taper;

w is the width of separation between locked connectors when the surfaces of the parts with which they are associated are generally planar, measured at generally about one-half the distance between such surfaces;

T is the distance between said external parallel surfaces with said distance of all of said parts being generally the same; and x has a value indicative of the number of connections making up said piece and the direction of said taper.

23. The interlocking piece of claim 22 wherein at least one of said connectors is a tapered, reentrant cavity to capture a complementary tapered knob projecting from another piece.

* * * * *